US011228099B2

(12) United States Patent
Shen

(10) Patent No.: US 11,228,099 B2
(45) Date of Patent: Jan. 18, 2022

(54) OMNIDIRECTIONAL ANTENNA AND ELECTRONIC DEVICE

(71) Applicant: AAC Technologies Pte. Ltd., Singapore (SG)

(72) Inventor: Yachuan Shen, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 16 days.

(21) Appl. No.: 16/702,487

(22) Filed: Dec. 3, 2019

(65) Prior Publication Data

US 2020/0212550 A1 Jul. 2, 2020

(30) Foreign Application Priority Data

Dec. 28, 2018 (CN) ..... 201822240807.9

(51) Int. Cl.
*H01Q 1/38* (2006.01)
*H01Q 9/40* (2006.01)

(52) U.S. Cl.
CPC ..... *H01Q 1/38* (2013.01); *H01Q 9/40* (2013.01)

(58) Field of Classification Search
CPC .. H01Q 1/38; H01Q 9/40; H01Q 1/40; H01Q 1/42; H01Q 5/378; H01Q 1/2291
See application file for complete search history.

(56) References Cited

U.S. PATENT DOCUMENTS

2004/0017315 A1* 1/2004 Fang ..... H01Q 5/371 343/700 MS
2016/0365624 A1* 12/2016 Maley ..... H01Q 21/0006

FOREIGN PATENT DOCUMENTS

CN 102142620 A1 8/2011
CN 104953288 A1 9/2015

OTHER PUBLICATIONS

PCT search report dated Jan. 23, 2020 by SIPO in related PCT Patent Application No. PCT/CN2019/113308(9 Pages).

* cited by examiner

*Primary Examiner* — David E Lotter
(74) *Attorney, Agent, or Firm* — W&G Law Group

(57) ABSTRACT

The present invention provides an omnidirectional antenna and an electronic device. The omnidirectional antenna includes a dielectric substrate, a first metal sheet and a second metal sheet that are printed on a surface of the dielectric substrate, wherein the first metal sheet is rectangular, the second metal sheet is in a strip shape with one wide end and one narrow end, the first metal sheet and the second metal sheet are arranged in a coaxial manner and spaced one another, and the wide end of the second metal sheet is close to the first metal sheet.

14 Claims, 5 Drawing Sheets

OMNIDIRECTIONAL ANTENNA AND ELECTRONIC DEVICE

TECHNICAL FIELD

The present disclosure relates to the field of communication technologies, and more particularly, to an omnidirectional antenna and an electronic device.

BACKGROUND

An omnidirectional antenna refers to a kind of antenna capable of realizing 360° uniform radiation in a horizontal plane. This kind of antenna is widely used in a base station antenna in mobile communication. For example, the omnidirectional antenna can be used to achieve a wide range of coverage in suburban and rural areas where the density of mobile users is relatively low. In addition, the omnidirectional antenna is also widely used for signal detection and interference in security and military fields.

The omnidirectional antenna in the related art usually includes a necked copper pipe and a rectangular right-angle routing arranged in the necked copper pipe, this kind of antenna mainly has the defects of low spiral efficiency, insufficient structure strength of the necked copper pipe, high cost and the like, and the rectangular right-angle routing solution is generally complex in routing and requires high processing accuracy and speed.

Therefore, it is necessary to provide an improved omnidirectional antenna to solve the problems above.

BRIEF DESCRIPTION OF THE DRAWINGS

In order to illustrate the technical solutions in the embodiments of the present disclosure more clearly, the drawings used in the description of the embodiments will be briefly described below. Obviously, the drawings in the following description are merely some embodiments of the present disclosure. Those of ordinary skills in the art can also obtain other drawings according to these drawings without going through any creative work, wherein.

DETAILED DESCRIPTION

The following clearly and completely describes the technical solutions in the embodiments of the present disclosure with reference to the accompanying drawings in the embodiments of the present disclosure. Apparently, the described embodiments are merely some but not all of the embodiments of the present disclosure. Based on the embodiments of the present disclosure, all other embodiments obtained by those of ordinary skills in the art without going through any creative work shall fall within the scope of protection of the present disclosure.

Figure 1:
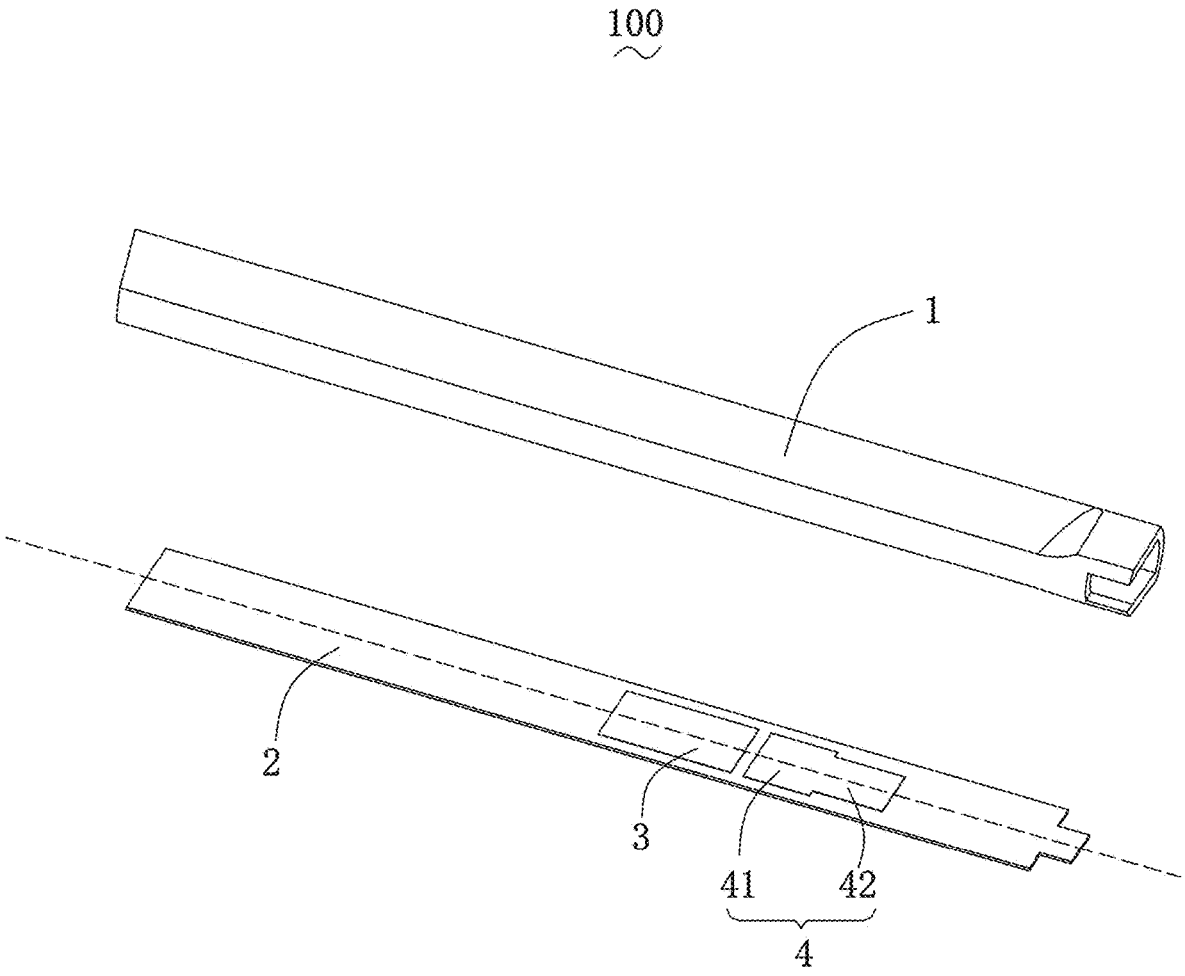
FIG. 1 is a perspective exploded structure diagram of an omnidirectional antenna according to a preferred embodiment provided by the present disclosure.

With reference to FIG. 1, the present disclosure provides an omnidirectional antenna 100, which can be applied to a router, a switch and other electronic devices. The omnidirectional antenna 100 includes an insulating housing 1, a dielectric substrate 2 arranged in the insulating housing 1, a first metal sheet 3 and a second metal sheet 4 that are printed on a surface of the dielectric substrate 2. The omnidirectional antenna 100 can be fixed to the electronic device through the insulating housing 1.

The dielectric substrate 2 is rectangular, and certainly, the dielectric substrate 1 is not limited to the rectangular shape, so as to be applied to various shapes of insulating housing.

The first metal sheet 3 is rectangular, and the second metal sheet 4 is in a strip shape with one wide end and one narrow end. The first metal sheet 3 and the second metal sheet 4 are arranged in a coaxial manner and spaced one another, and the wide end of the second metal sheet 4 is close to the first metal sheet 3. The first metal sheet 3 and the second metal sheet 4 are printed on the same surface of the dielectric substrate 2, and will not occupy an additional space, so that the omnidirectional antenna has a smaller volume and a more compact structure. Moreover, the first metal sheet 3 and the second metal sheet 4 have large areas and regular shapes, and thus have low requirements on processing accuracy, and are easy to process.

The second metal sheet 4 includes a first rectangular portion 41 and a second rectangular portion 42 extending from one end of the first rectangular portion 41 towards a direction away from the first metal sheet 41, the first rectangular portion 41 is coaxially arranged with the second rectangular portion 42, and a width of the first rectangular portion 41 is the same as that of the first metal sheet 3.

Further, the width of the first rectangular portion 41 is greater than that of the second rectangular portion 42, and a length of the first rectangular portion 41 is the same as that of the second rectangular portion 42.

Further, a length of the first metal sheet 3 is the same as that of the second metal sheet 4.

A space between the first metal sheet 3 and the second metal sheet 4 is not specifically limited, and shapes of the first metal sheet 3 and the second metal sheet 4 and the space between the first metal sheet 3 and the second metal sheet 4 can be appropriately adjusted to meet the resonance requirements.

The omnidirectional antenna operates in frequency bands of 2.4 GHz to 2.5 GHz and 5.15 GHz to 5.85 GHz.

Figure 2:
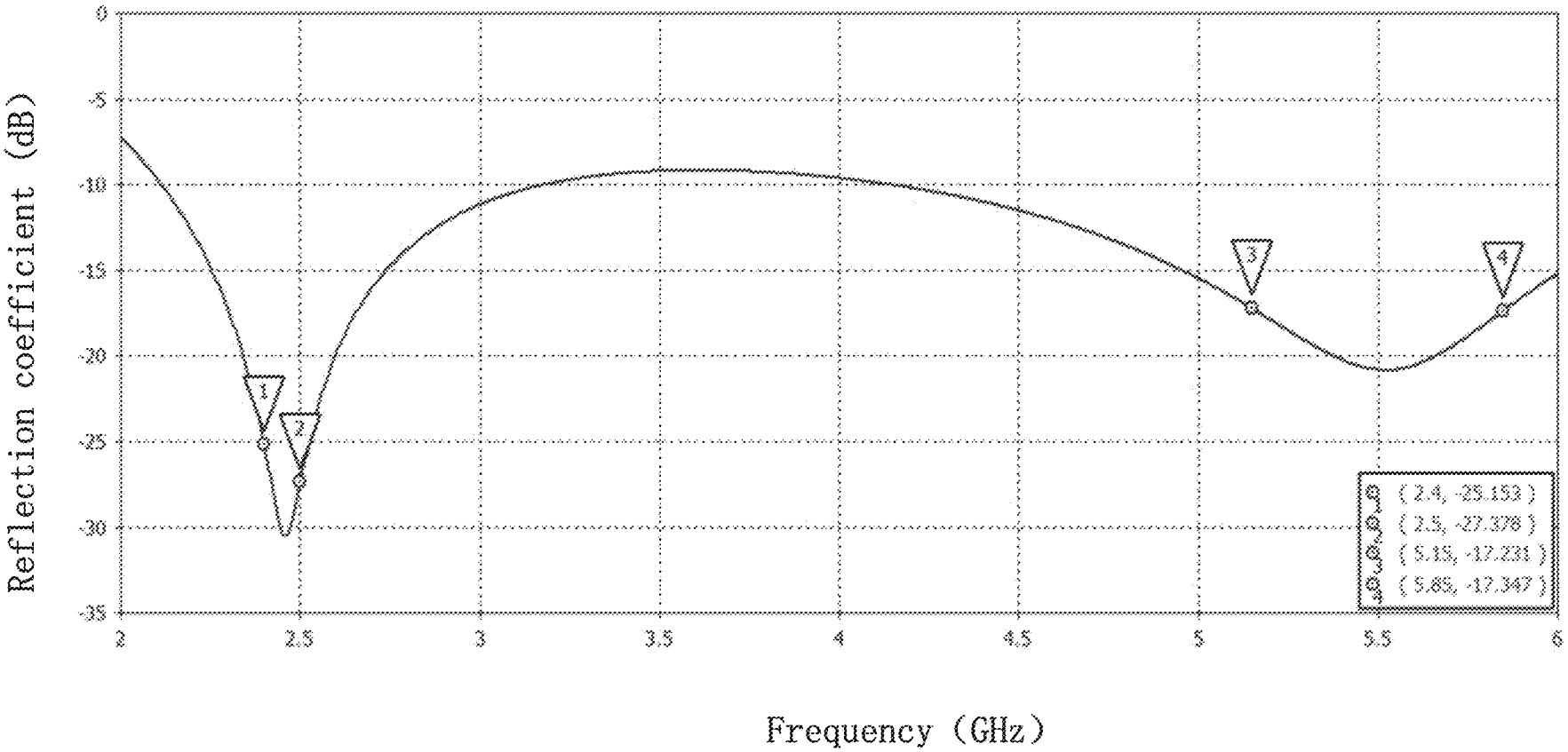
FIG. 2 is a reflection coefficient diagram of the omnidirectional antenna provided by the present disclosure.
Figure 3:
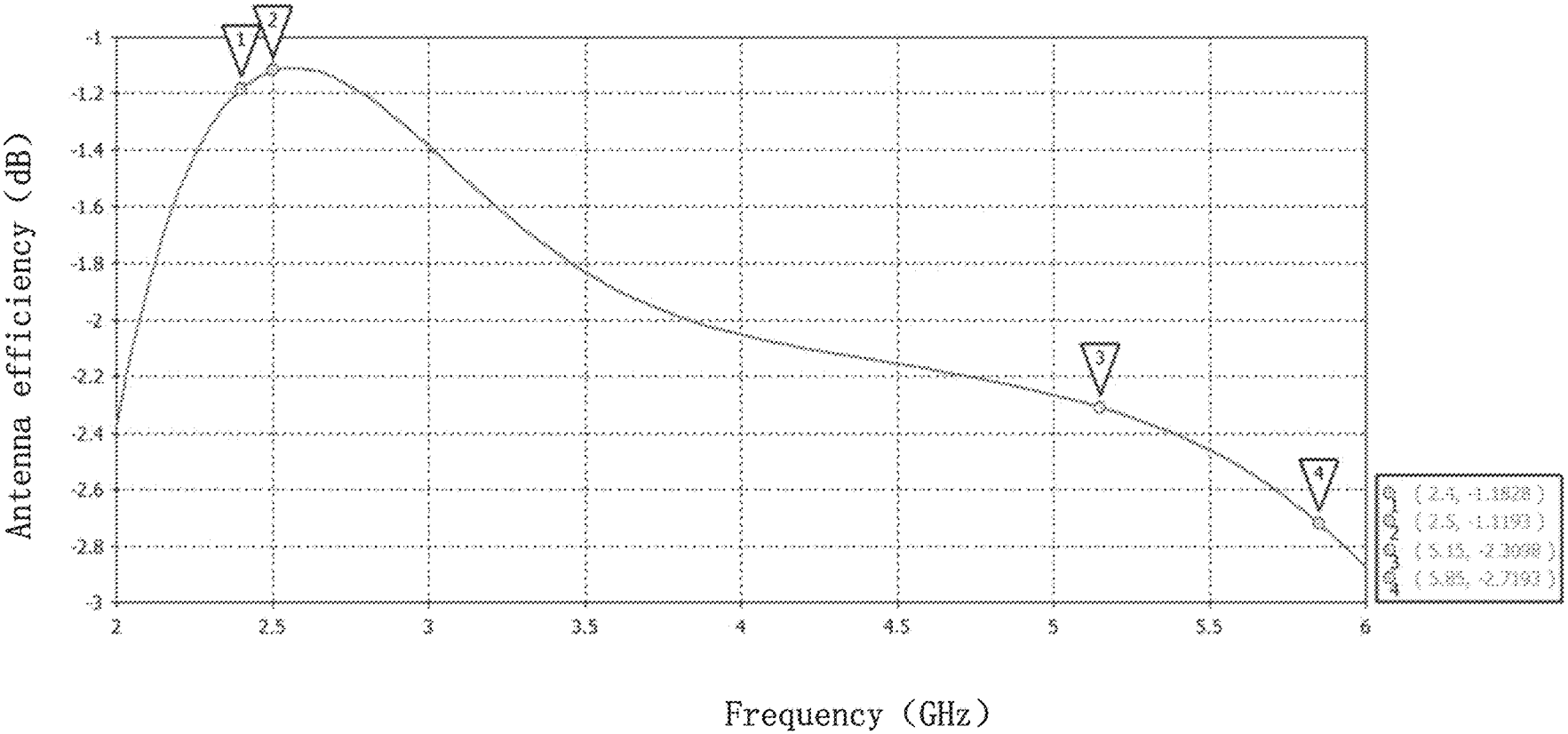
FIG. 3 is an antenna efficiency diagram of the omnidirectional antenna provided by the present disclosure.

With reference to FIG. 2, the omnidirectional antenna provided by the present disclosure has a very wide working bandwidth, a reflection coefficient S11 is subject to −10 dB, and when 2.45 GHz is used as a center point, the bandwidth can reach 1 GHz; and when 5.5 GHz is used as a center, the bandwidth can reach 2.5 GHz. With reference to FIG. 3, it can be seen that an antenna efficiency of the omnidirectional antenna generally ranges from −1.1 dB to −3 dB in the frequency band above, which can meet the actual needs.

Figure 4:
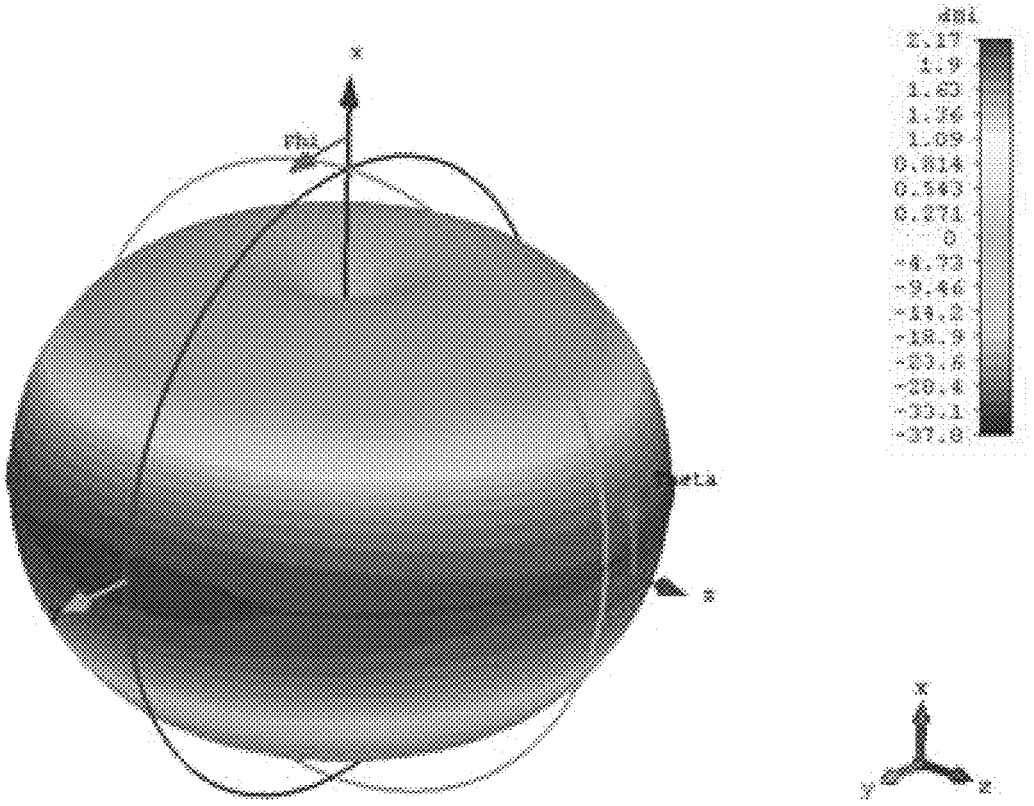
FIG. 4 is a direction diagram of the omnidirectional antenna provided by the present disclosure at 2.45 GHz.

FIG. 4 is a direction diagram of the omnidirectional antenna provided by the present disclosure at 2.45 GHz, and it can be clearly seen from the drawing that a radiation direction is in an apple shape, which can cover the surrounding at 360°, and the gain can reach 2.17 dB.

Figure 5:
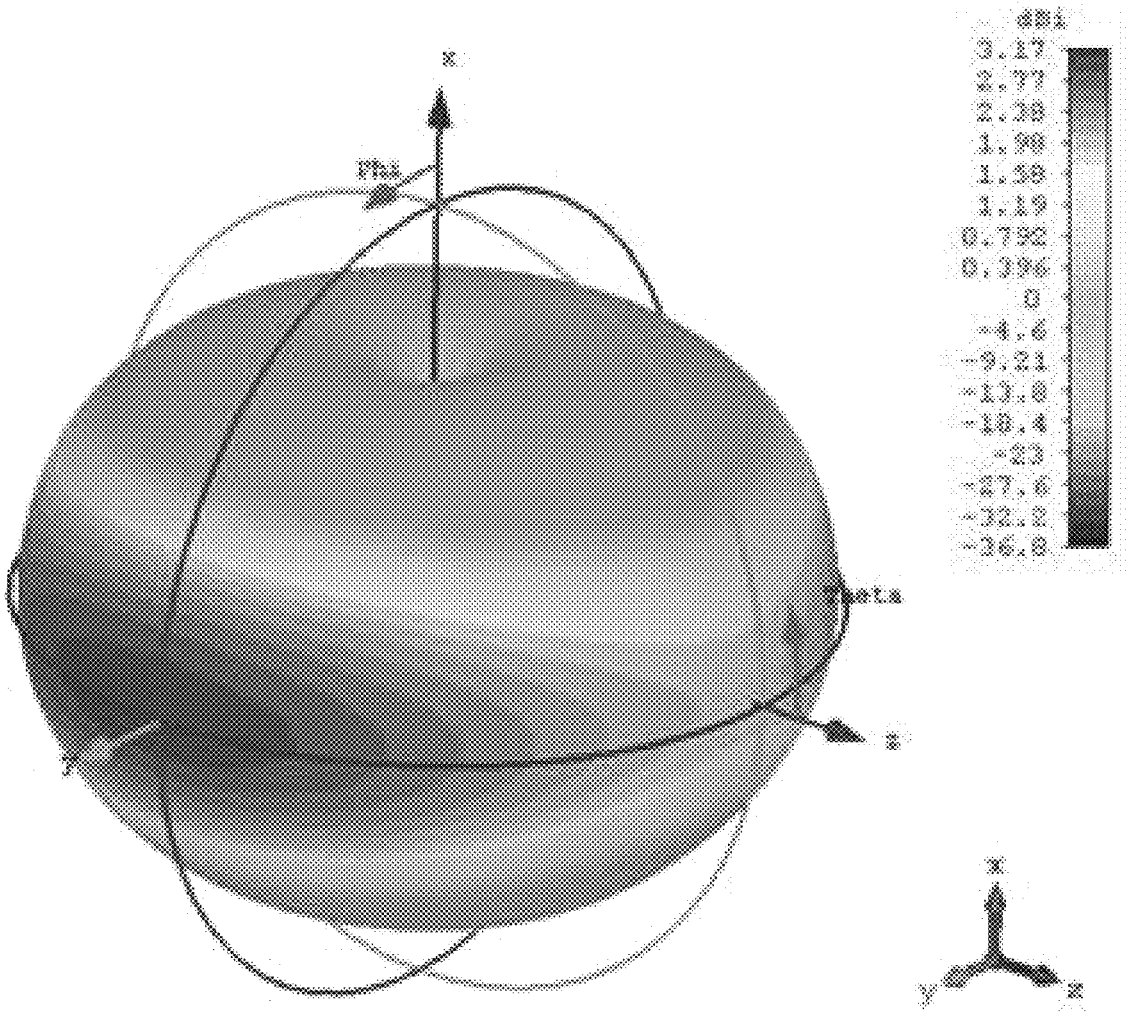
FIG. 5 is a direction diagram of the omnidirectional antenna provided by the present disclosure at 5.5 GHz.

FIG. 5 is a direction diagram of the omnidirectional antenna provided by the present disclosure at 5.5 GHz, and it can be clearly seen from the drawing that a radiation direction is in an apple shape, which can cover the surrounding at 360°, and the gain can reach 3.17 dB.

Compared with the related art, the omnidirectional antenna and the electronic device provided by the present disclosure have the following beneficial effects of:

1. small volume, regular and continuous structure, and easy processing;

2. large bandwidth, capable of supporting frequency bands of 2.4 GHz to 2.5 GHz and 5.15 GHz to 5.85 GHz; and 3. low requirements on processing accuracy, which is easy to adapt to various shapes of insulating housings.

The description above is merely embodiments of the present disclosure, and it should be pointed out that, those of ordinary skills in the art can make improvements without departing from the inventive concept of the present disclosure, but these all belong to the scope of protection of the present disclosure.

What is claimed is:

1. An omnidirectional antenna, comprising:

a dielectric substrate;

a first metal sheet and a second metal sheet that are printed on a surface of the dielectric substrate;

wherein the first metal sheet is rectangular, the second metal sheet is in a strip shape with one wide end and one narrow end, the first metal sheet and the second metal sheet are arranged in a coaxial manner and spaced apart from each other, and the wide end of the second metal sheet is closer to the first metal sheet than the narrow end.

2. The omnidirectional antenna according to claim 1, wherein the second metal sheet comprises:

a first rectangular portion; and a second rectangular portion extending from one end of the first rectangular portion towards a direction away from the first metal sheet;

wherein the first rectangular portion is coaxially arranged with the second rectangular portion, and a width of the first rectangular portion is the same as a width of the first metal sheet.

3. The omnidirectional antenna according to claim 2, wherein the width of the first rectangular portion is greater than a width of the second rectangular portion, and a length of the first rectangular portion is the same as a length of the second rectangular portion.

4. The omnidirectional antenna according to claim 1, wherein a length of the first metal sheet is the same as a length of the second metal sheet.

5. The omnidirectional antenna according to claim 3, wherein a length of the first metal sheet is the same as a length of the second metal sheet.

6. The omnidirectional antenna according to claim 1, wherein the omnidirectional antenna operates in frequency bands of 2.4 GHz to 2.5 GHz and 5.15 GHz to 5.85 GHz.

7. The omnidirectional antenna according to claim 1, wherein the omnidirectional antenna further comprises an insulating housing, and the dielectric substrate is arranged in the insulating housing.

8. An electronic device, comprising an omnidirectional antenna;

wherein the omnidirectional antenna, comprising:

a dielectric substrate;

a first metal sheet and a second metal sheet that are printed on a surface of the dielectric substrate;

wherein the first metal sheet is rectangular, the second metal sheet is in a strip shape with one wide end and one narrow end, the first metal sheet and the second metal sheet are arranged in a coaxial manner and spaced apart from each other, and the wide end of the second metal sheet is closer to the first metal sheet than the narrow end.

9. The electronic device according to claim 8, wherein the second metal sheet comprises:

a first rectangular portion; and a second rectangular portion extending from one end of the first rectangular portion towards a direction away from the first metal sheet;

wherein the first rectangular portion is coaxially arranged with the second rectangular portion, and a width of the first rectangular portion is the same as a width of the first metal sheet.

10. The electronic device according to claim 9, wherein the width of the first rectangular portion is greater than a width of the second rectangular portion, and a length of the first rectangular portion is the same as a length of the second rectangular portion.

11. The electronic device according to claim 8, wherein a length of the first metal sheet is the same as a length of the second metal sheet.

12. The electronic device according to claim 10, wherein a length of the first metal sheet is the same as a length of the second metal sheet.

13. The electronic device according to claim 8, wherein the omnidirectional antenna operates in frequency bands of 2.4 GHz to 2.5 GHz and 5.15 GHz to 5.85 GHz.

14. The electronic device according to claim 8, wherein the omnidirectional antenna further comprises an insulating housing, and the dielectric substrate is arranged in the insulating housing.

* * * * *